US006066021A

United States Patent [19]

Lee

[11] Patent Number: 6,066,021

[45] Date of Patent: May 23, 2000

[54] GLASS DRINKING VESSEL WITH A BOTTOM ORNAMENT

[76] Inventor: Vincent Kuo Wei Lee, No. 44, Lane 458, Sheh Chung Street, Shih Lin,Taipei, Taiwan

[21] Appl. No.: 09/045,855

[22] Filed: Mar. 23, 1998

[51] Int. Cl.[7] ..... A63H 3/52; A63H 33/04; B65D 1/04

[52] U.S. Cl. ..... 446/77; 446/267; 215/6; D7/536

[58] Field of Search ..... 446/77, 74, 267; 215/6, 383, 374, 386, 396; D7/515, 536, 537

[56] References Cited

U.S. PATENT DOCUMENTS

| | | | |
|---|---|---|---|
| D. 266,725 | 11/1982 | Sarpameva | D7/537 |
| 2,187,558 | 1/1940 | Kushima | 215/6 X |
| 2,196,450 | 4/1940 | Forgaard | 215/374 X |
| 2,374,092 | 4/1945 | Glaser | 215/6 |
| 4,324,338 | 4/1982 | Beall | 215/6 |
| 4,765,465 | 8/1988 | Yamada et al. | 215/386 X |
| 4,932,542 | 6/1990 | Chen et al. | 446/77 X |
| 5,029,700 | 7/1991 | Chen | 215/6 X |
| 5,487,486 | 1/1996 | Meneo | 215/6 X |
| 5,769,680 | 6/1998 | Hoffman | 446/74 X |

*Primary Examiner*—D. Neal Muir
*Attorney, Agent, or Firm*—Bacon & Thomas

[57] ABSTRACT

A glass drinking vessel includes a bottom or base portion which defines a clear bottom space with a downward-facing opening into which a clear liquid ornament is precisely fitted and mounted by means of clear resin adhesive. The liquid ornament includes a closed and clear housing in which at least one type of liquid and at least one floating ornamental item are contained to provide a changing scene. The liquid ornament associated with the bottom portion of a glass drinking vessel makes the glass drinking vessel cute, interesting, and attractive.

7 Claims, 7 Drawing Sheets

GLASS DRINKING VESSEL WITH A BOTTOM ORNAMENT

BACKGROUND OF THE INVENTION

The present invention relates to a glass drinking vessel with a bottom ornament, and more particularly to a glass drinking vessel having a bottom or base portion which defines a transparent bottom space having a downward-facing opening into which a liquid ornament with a clear housing is adhered, making the glass drinking vessel novel and cute.

There are various kinds of liquid ornaments available in the markets. These liquid ornaments have differently shaped clear housings and are usually used as ornamental paper weights or pen holders. On the other hand, there are various kinds of glass drinking vessels frequently seen and used in our daily life. These glass drinking vessels can also be used as ornaments to decorate our house or office. The glass drinking vessels may have different changeable designs, but they all have a bottom or base portion that always has a simple and monotonous shape without any special or additional ornamental structure. A inclusion of a changeable liquid ornament in the bottom or base portion of a glass drinking vessel will interestingly decorate the glass drinking vessel.

SUMMARY OF THE INVENTION

A primary object of the present invention is to provide a glass drinking vessel with a bottom ornament while the glass drinking vessel maintains its existing function.

To attach the ornament to the bottom of the glass drinking vessel, the glass drinking vessel is formed with a clear bottom or base portion which defines a bottom space having a downward-facing opening into which the ornament is adhered. The ornament is preferably a liquid ornament having a clear housing, so that beautiful changes of the liquid in the ornamental housing can be seen from outside of the bottom or base portion of the glass drinking vessel. With the liquid ornament attached thereto, the originally monotonous bottom or base portion of the glass drinking vessel can have a completely different and interesting appearance now.

DETAILED DESCRIPTION OF THE PREFERRED EMBODIMENTS

Figure 1:
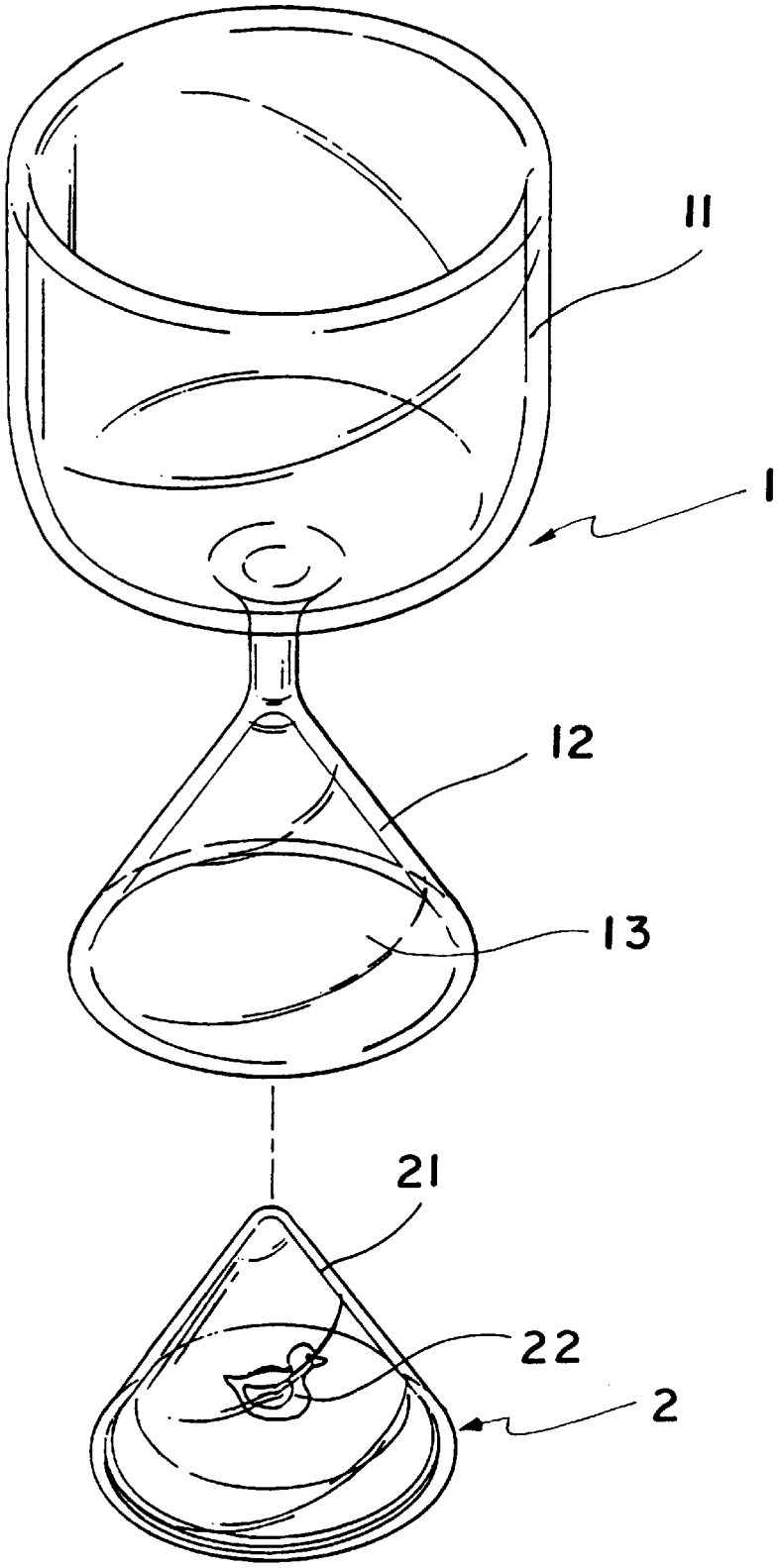
FIG. 1 is an exploded perspective view of a glass drinking vessel with bottom ornament according to a first embodiment of the present invention.

A glass drinking vessel generally includes a container portion and a bottom portion for a tumbler or a base portion for a stemware, such as a goblet. In FIG. 1, a goblet 1 is illustrated for the purpose of describing a glass drinking vessel with bottom ornament according to a first embodiment of the present invention. As shown, the goblet 1 is made of clear glass and includes a container portion 11 for containing drink therein and a base portion 12. Unlike a conventional flat and solid base portion for a goblet, the base portion 12 of the goblet 1 designed according to the present invention defines a transparent bottom space 13 having a downward-facing opening. The space 13 may have different dimensions and shapes, so long as it matches with the container portion 11 to create a beautiful formation for the goblet 1. A liquid ornament 2 having dimensions and shape corresponding to that of the space 13 is fixedly disposed in the space 13.

The liquid ornament 2 includes a clear housing 21 having at least one ornamental item 22 contained therein. The at least one ornamental item 22 may be either a dual-liquid or a single-liquid with ornamental items floating thereon. The housing 21 has an outer configuration fully matching with the dimensions and shape of the space 13, so that the whole liquid ornament 2 can fit in the space 13 with a minimal clearance and preferably no clearance at all, between an outer surface of the liquid ornament 2 and an inner surface of the bottom space 13. Any clearance between the inner surface of the space 13 and the liquid ornament 2 would result in reflection of light due to air existing in the clearance. On the contrary, fully and precisely contacting of the liquid ornament 2 with the inner surface of the bottom space 13 would make the base portion 12 and the liquid ornament 2 look like a transparent unit.

Figure 2:
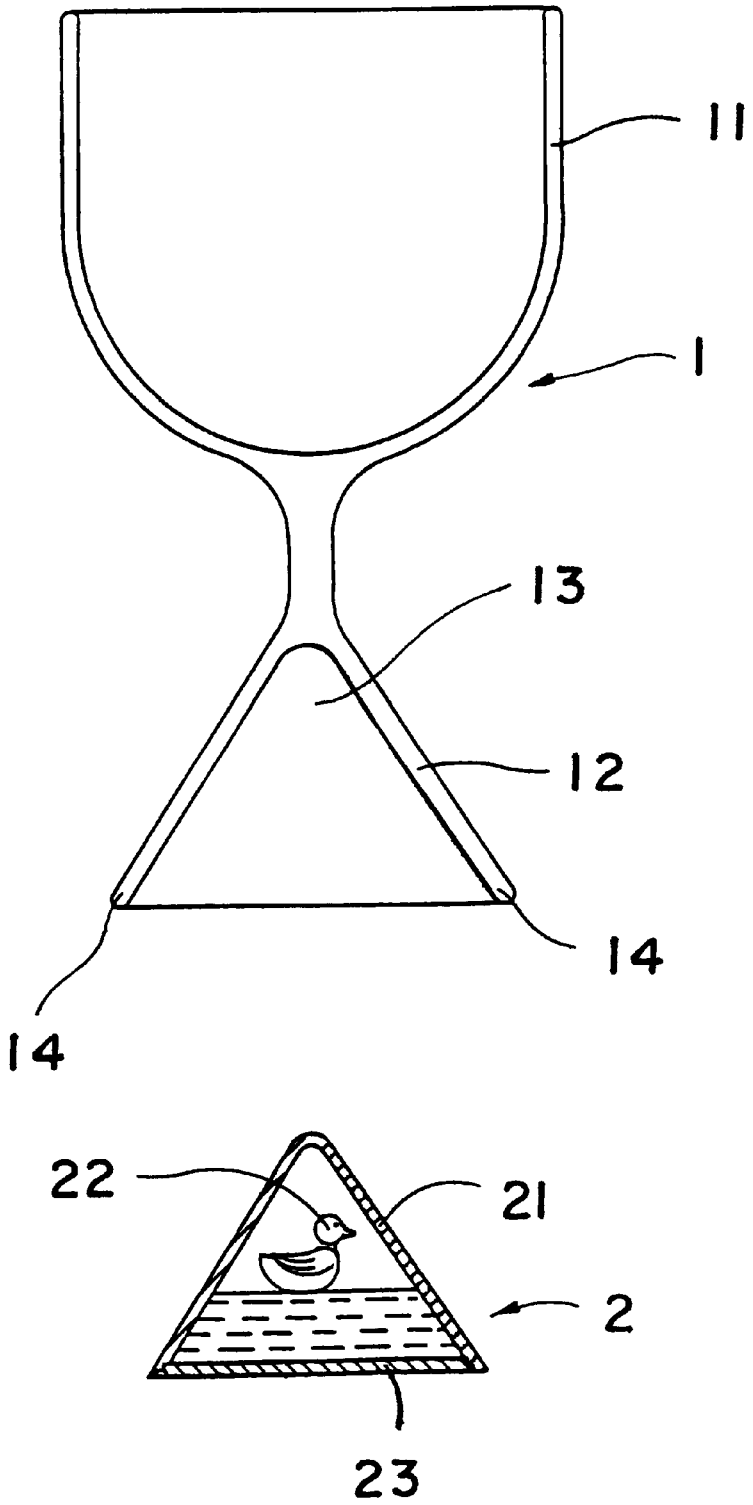
FIG. 2 is an exploded sectional view of the glass drinking vessel with bottom ornament of FIG. 1.
Figure 3:
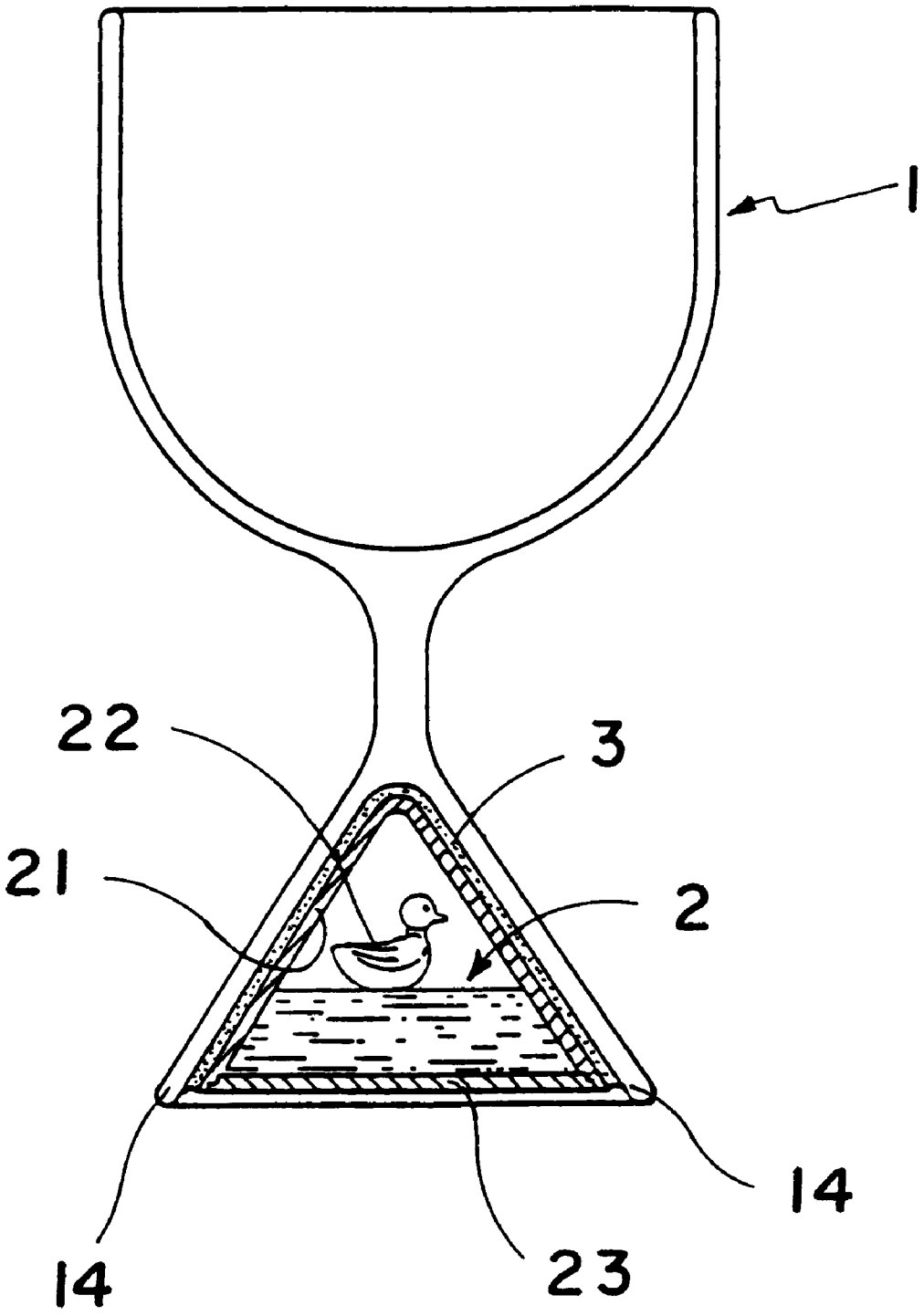
FIG. 3 is an assembled sectional view of the glass drinking vessel with bottom ornament of FIG. 1.

What is to be noted is the that liquid ornament 2 is disposed in the space 13 without projecting its bottom surface 23 from a bottom periphery 14 of the base portion 12, as shown in FIGS. 2 and 3, so that the whole goblet 1 may keep its stable upstanding position with the bottom periphery 14 being exactly fitted into a surface on which the goblet 1 is positioned.

The liquid ornament 2 may be fixedly attached to the base portion 12 in the space 13 by applying a layer of clear resin adhesive around a joint between the bottom surface 23 of the liquid ornament 2 and the bottom periphery 14 of the base portion 12, as shown in FIG. 3.

There is a possibility that a clearance exists between the liquid ornament 2 and the inner surface of the bottom space 13 due to inaccuracy of dimensions caused by mass production of the goblet 1 as well as the liquid ornament 2. As described above, such clearance will inevitably affect the transparency of the base portion 12 having the liquid ornament 2 disposed therein. A possible and simple solution is to apply a layer of clear resin adhesive 3 on the entire inner surface of the space 13 before the liquid ornament 2 is put into the space 13. The clear resin adhesive 3 not only ensures an absolute adherence of the liquid ornament 2 to the base portion 12, but also serves as a good intermedium to maintain the existing transparency of the clear base portion 12.

Figure 4:
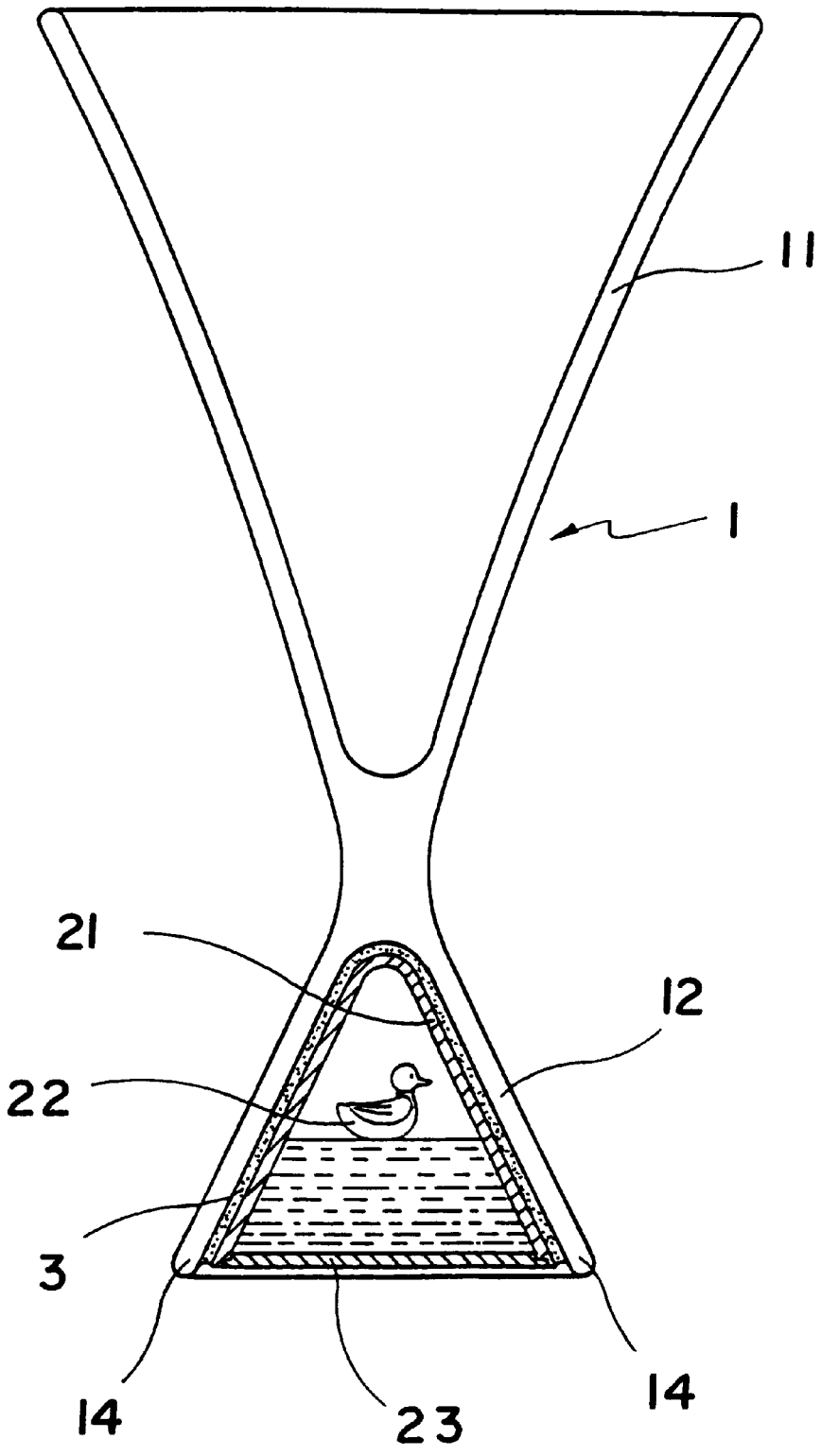
FIG. 4 is an assembled sectional view of another glass drinking vessel with bottom ornament according to the first embodiment of the present invention.
Figure 5:
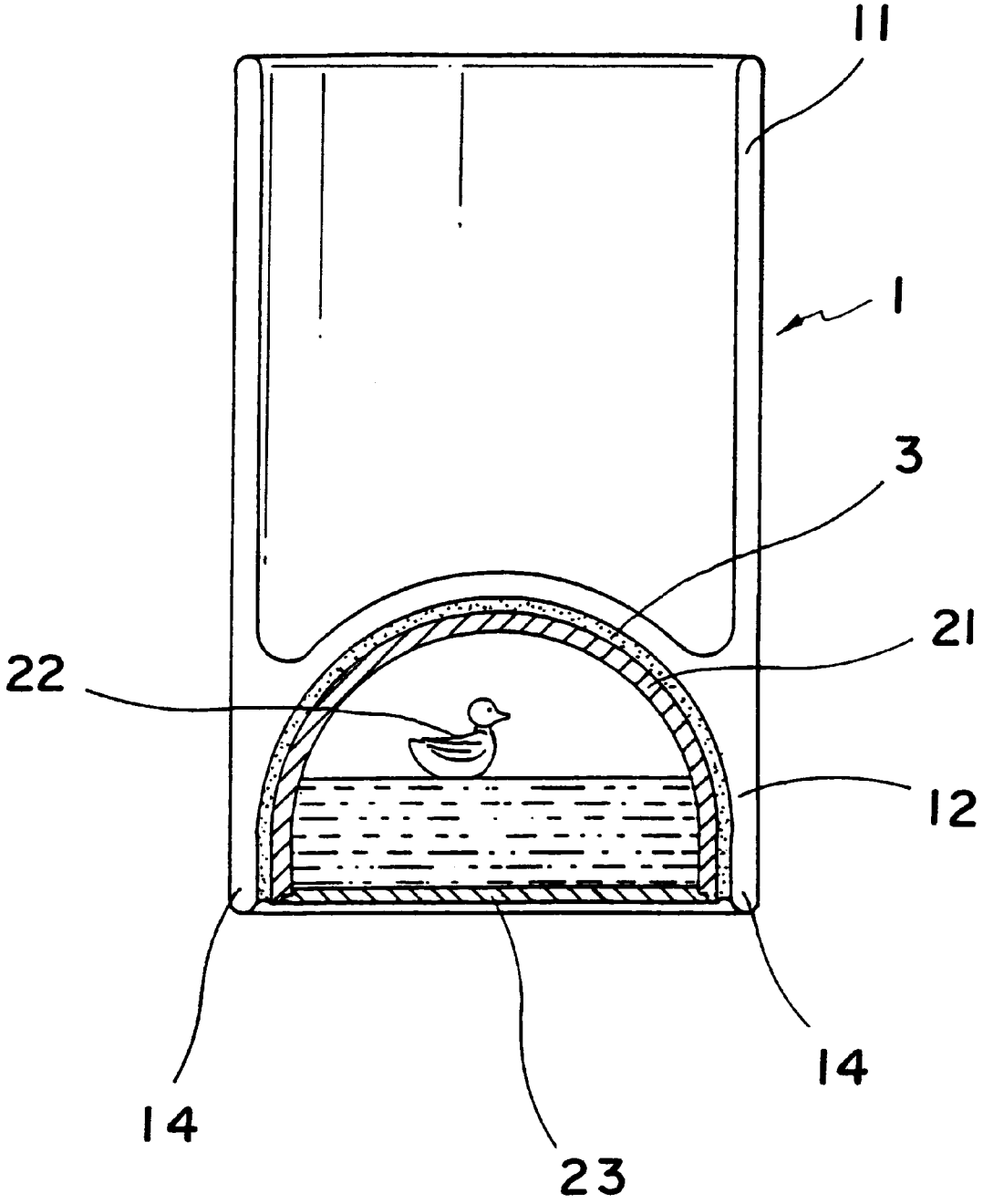
FIG. 5 is an assembled sectional view of a further glass drinking vessel with bottom ornament according to the first embodiment of the present invention.

FIGS. 4 and 5 respectively illustrate a glass 1 having shapes different from that shown in FIGS. 1 to 3. However, the two glasses 1 in FIGS. 4 and 5 all include a container portion 11 and a base portion 12 (or bottom portion 12 for the glass 1 in FIG. 5), and the two base (or bottom) portions 12 all define a space 13 below them to accommodate a liquid ornament 2 therein. Again, clear resin adhesive 3 is used as an intermedium to firmly adhere the liquid ornament 2 to the inner surface of the space 13.

The clear resin adhesive 3 applied on the inner surface of the space 13 is particularly shown in increased thickness in FIGS. 3, 4 and 5 for illustrative purpose only. In actual applications, thickness of the applied resin adhesive 3 is largely reduced due to a high accuracy required in the whole production of the glass drinking vessel 1 and the liquid ornament 2. High accuracy of products and less amount of resin adhesive are, of course, beneficial to lower manufacturing costs.

Figure 6:
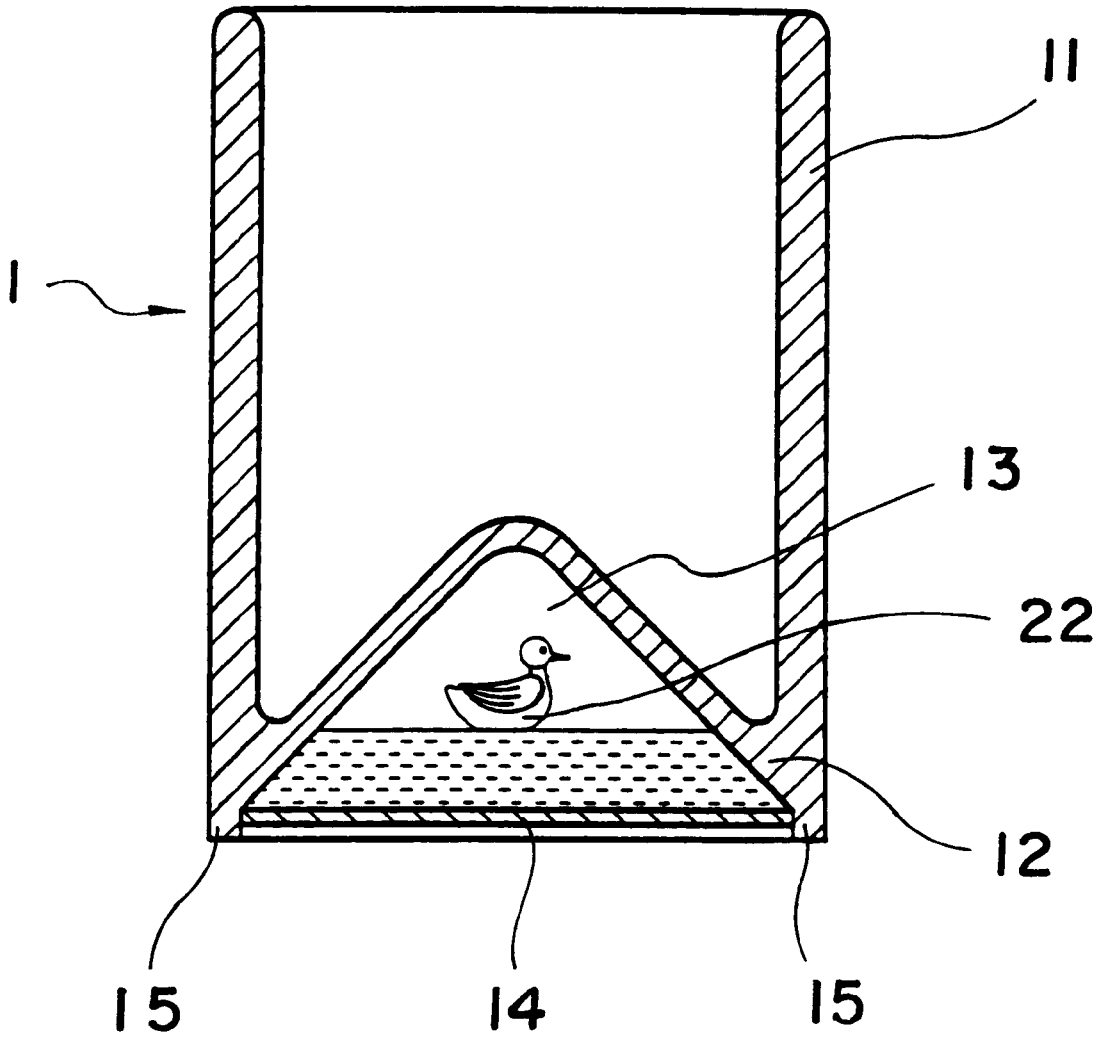
FIGS. 6 and 7 illustrate two differently shaped glass drinking vessels with bottom ornament ornament according to another embodiment of the present invention.
Figure 7:
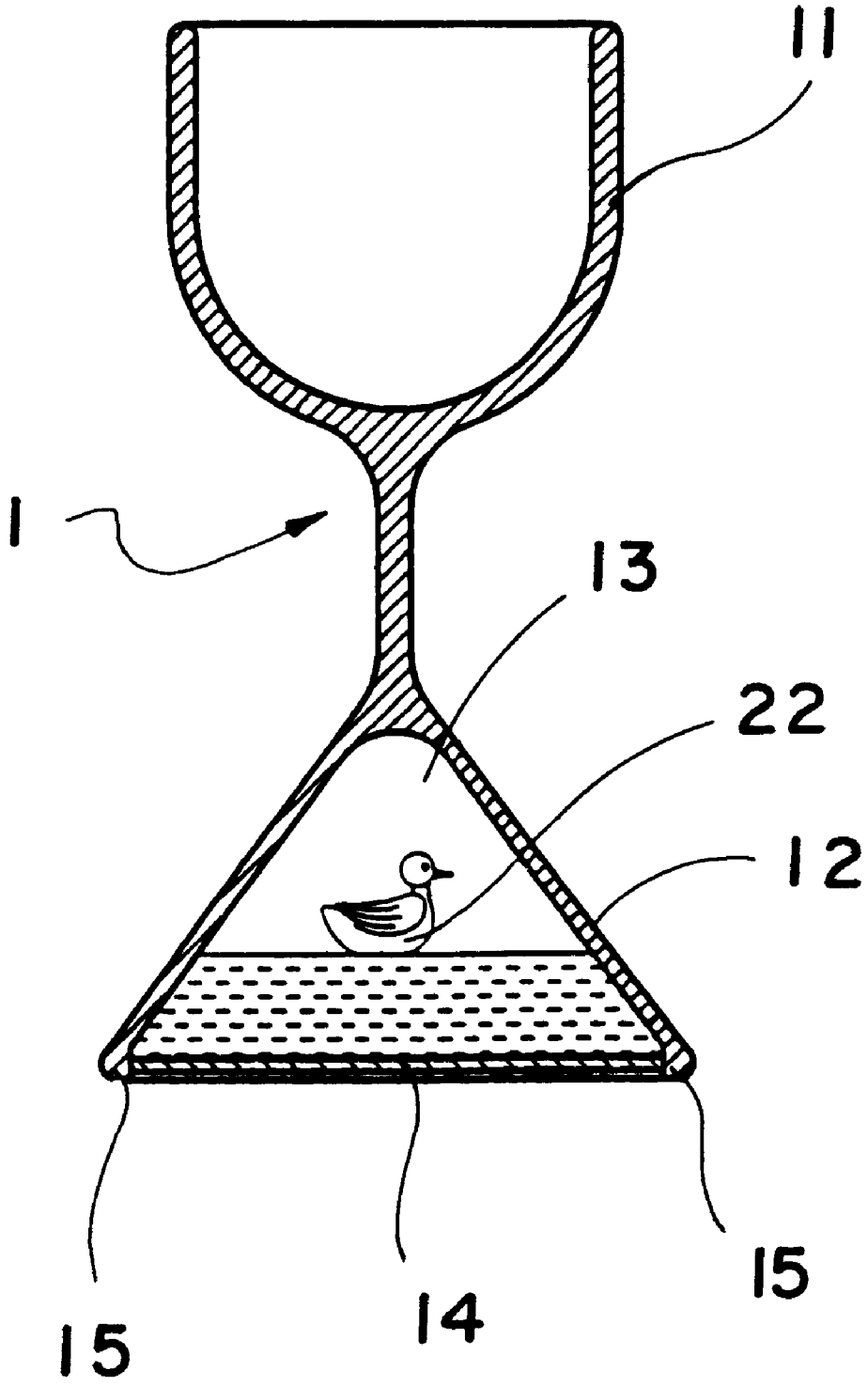

Please now refer to FIGS. 6 and 7 which respectively illustrate a tumbler and a goblet which are both indicated by numeral reference 1 and will be hereinafter briefly referred to as the glass 1. The glass 1 is formed according to another embodiment of the present invention to include a container portion 11 and a base (or bottom) portion 12. The base (or bottom) portion 12 defines a bottom space 13 having a downward-facing opening. The space 13 is closed by sealing a bottom cover 14 thereto by means of ultrasonic heating. As shown in the drawings, an outer surface of the bottom cover 14 is slightly withdrawn from a bottom periphery 15 of the base (or bottom) portion 12, so that the closed space 13 does not affect the stable upstanding position of the glass 1. At least one type of liquid ornamental item 22 is contained in the space 13 before it is closed with the bottom cover 14.

It that to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A glass drinking vessel with a bottom ornament, comprising a container portion, a clear base portion below said container portion, and a liquid ornament; said clear base portion being made of clear glass and defining a bottom space having a downward-facing opening; said liquid ornament including a closed clear housing in which at least one type of liquid is contained, and said liquid ornament having dimensions and a shape that matches corresponding dimensions and a shape of said bottom space defined by said base portion and connected to said bottom space by means of a clear resin adhesive, said clear resin adhesive serving as an intermedium to maintain a transparency of said clear base portion.

2. A glass drinking vessel with bottom ornament as claimed in claim 1, wherein said liquid ornament is connected to said bottom space by applying said clear resin adhesive around a joint between a bottom surface of said liquid ornament and a bottom periphery of said base portion.

3. A glass drinking vessel with bottom ornament as claimed in claim 1, wherein said liquid ornament is connected to said bottom space by applying said clear resin adhesive on an inner surface of said bottom space.

4. A glass drinking vessel with bottom ornament as claimed in claim 1, wherein said bottom space further includes an ornamental item that floats in said liquid.

5. A glass drinking vessel with bottom ornament as claimed in claim 1, wherein said bottom space further includes an ornamental item that floats in said liquid.

6. A glass drinking vessel with a bottom ornament, comprising a container portion, a base portion below said container portion, and a liquid ornament; said base portion being made of clear glass and defining a bottom space having a downward-facing opening; said bottom space being closed by sealing a bottom cover thereto by means of ultrasonic heating, said bottom space containing at least two types of liquid, making said bottom space a liquid ornament at a bottom of said glass drinking vessel.

7. A glass drinking vessel with bottom ornament as claimed in any of the above claims, wherein said base portion has a bottom periphery which always projects from a bottom surface of said liquid ornament to maintain said glass drinking vessel in a stable upstanding position.

* * * * *